US007604015B2

(12) United States Patent
Fraser

(10) Patent No.: US 7,604,015 B2
(45) Date of Patent: Oct. 20, 2009

(54) UMBRELLA HAVING STRUCTURAL RIB CONFIGURED TO RECEIVE ELECTRICAL COMPONENTS AND ASSOCIATED WIRING

(75) Inventor: Joseph Fraser, Woodstock, GA (US)

(73) Assignee: Southern Sales & Marketing Group, Inc., Atlanta, GA (US)

( * ) Notice: Subject to any disclaimer, the term of this patent is extended or adjusted under 35 U.S.C. 154(b) by 298 days.

(21) Appl. No.: 11/241,889

(22) Filed: Sep. 30, 2005

(65) Prior Publication Data

US 2007/0074751 A1 Apr. 5, 2007

(51) Int. Cl.
*A45B 25/00* (2006.01)
*A45B 3/04* (2006.01)

(52) U.S. Cl. ..... 135/31; 135/16; 135/910; 362/102

(58) Field of Classification Search ..... 135/910, 135/29, 31; 362/102
See application file for complete search history.

(56) References Cited

U.S. PATENT DOCUMENTS

| | | | |
|---|---|---|---|
| 2,960,094 | A | 11/1960 | Small |
| 4,920,897 | A | 5/1990 | Reed et al. |
| 5,053,931 | A | 10/1991 | Rushing |
| 5,055,984 | A | 10/1991 | Hung et al. |
| 5,126,922 | A | 6/1992 | Andreasen |
| 5,172,711 | A | 12/1992 | Mueller et al. |
| 5,273,062 | A | 12/1993 | Mozdzanowski |
| 5,349,975 | A | 9/1994 | Valdner |
| 5,463,536 | A | 10/1995 | Chou et al. |
| 5,584,564 | A | 12/1996 | Phyle |
| 5,611,614 | A | 3/1997 | Morgan |
| 5,664,874 | A | 9/1997 | Winterer |
| 5,758,948 | A | 6/1998 | Hale |
| 5,911,493 | A | 6/1999 | Walker et al. |

(Continued)

FOREIGN PATENT DOCUMENTS

| | | |
|---|---|---|
| JP | 9168415 | 6/1997 |

(Continued)

OTHER PUBLICATIONS

Kuelbs, Gregory, G., Second Declaration Under 37C.F.R. §1.131 and Exhibits; Reexamination of Pat. No. 6612713; submitted Jan. 29, 2007.

*Primary Examiner*—David Dunn
*Assistant Examiner*—Danielle Jackson
(74) *Attorney, Agent, or Firm*—Kilpatrick Stockton LLP

(57) ABSTRACT

An umbrella has a first support member, a plurality of ribs supported by the first support member, and a canopy supported by the plurality of ribs. At least one of the plurality of ribs has, in cross section, a bottom wall, first and second upstanding side walls extending upward from the bottom wall, and a web extending between the first and second side walls at a location intermediate the bottom wall and the upper side wall ends. The web and upper portions of the first and second side walls form a channel. A first hole extends through the web, and a second hole extends through the bottom wall generally in coaxial alignment with the first hole. In a disclosed embodiment, a light bulb is disposed within either or both of the first and second holes, and an insulated electrical conductor runs along the length of the rib within the channel to connect the light bulb to a source of electrical power.

5 Claims, 4 Drawing Sheets

U.S. PATENT DOCUMENTS

| | | | | |
|---|---|---|---|---|
| 6,017,188 | A | 1/2000 | Benton | |
| 6,058,951 | A | 5/2000 | Wilson | |
| 6,059,430 | A | 5/2000 | Chen | |
| 6,089,727 | A | 7/2000 | Wu | |
| 6,126,293 | A | 10/2000 | Wu | |
| 6,182,917 | B1 | 2/2001 | Lai | |
| 6,270,230 | B1 | 8/2001 | Mai | |
| 6,298,866 | B1 | 10/2001 | Molnar, IV | |
| 6,299,325 | B1 | 10/2001 | Cathel | |
| 6,341,873 | B1 | 1/2002 | Yang | |
| 6,406,163 | B1 | 6/2002 | Yang | |
| 6,439,249 | B1 | 8/2002 | Pan et al. | |
| 6,499,856 | B2 | 12/2002 | Lee | |
| 6,598,990 | B2 | 7/2003 | Li | |
| 6,612,713 | B1 | 9/2003 | Kuelbs | |
| 6,666,224 | B2 | 12/2003 | Lee | |
| 6,692,135 | B2 | 2/2004 | Li | |
| 6,729,742 | B2 | 5/2004 | Wismeth et al. | |
| 6,923,194 | B2 | 8/2005 | Li | |
| 6,966,667 | B2 | 11/2005 | Li | |
| 7,013,903 | B2 | 3/2006 | Li | |
| 7,108,388 | B2 | 9/2006 | Li | |
| 2002/0078985 | A1 | 6/2002 | Farr | |
| 2003/0084931 | A1* | 5/2003 | Lee | 135/16 |
| 2004/0031510 | A1* | 2/2004 | Li | 135/21 |
| 2004/0149325 | A1 | 8/2004 | Kuelbs | |
| 2005/0072451 | A1 | 4/2005 | Vivian et al. | |
| 2005/0155636 | A1* | 7/2005 | Lee | 135/31 |
| 2006/0005869 | A1 | 1/2006 | Kuelbs | |
| 2007/0074750 | A1* | 4/2007 | Harbaugh | 135/91 |

FOREIGN PATENT DOCUMENTS

| | | |
|---|---|---|
| WO | WO93/00840 | 1/1993 |

* cited by examiner

UMBRELLA HAVING STRUCTURAL RIB CONFIGURED TO RECEIVE ELECTRICAL COMPONENTS AND ASSOCIATED WIRING

FIELD OF THE INVENTION

This invention relates generally to an umbrella, and more particularly to an umbrella having a structural rib configured to receive one or more electrical components and associated wiring.

BACKGROUND OF THE INVENTION

Large patio-style umbrellas are useful on patios, decks, pools, beaches, and in other outdoor settings for providing protection from the sun and allowing users a convenient way to enjoy shade while participating in outdoor activities. Often such activities continue into the night, and it is desirable to have convenient outdoor lighting. One method for providing such outdoor lighting is to equip the umbrella with lights powered by either household current or a battery. In the case of a battery-powered lighting system, the battery can be charged during the day by a solar panel. Patio umbrellas can provide a convenient housing for the solar panel, battery, lights, and wiring needed for such lighting. It is desirable though that the battery, lights, and wiring be housed in such as way as to maximize the aesthetic appeal of the umbrella, minimize weathering, increase safety and convenience, and do so in a cost effective way. Embodiments of the present invention achieve these and other results as described more fully below.

SUMMARY

Embodiments of the present invention provide an attractive, safe, and convenient way of housing lights or other electrical appliances and wiring within a patio umbrella. Stated somewhat more specifically, embodiments of the present invention comprise an umbrella having a first support member, a plurality of elongated ribs supported by the first support member, and a canopy supported by the plurality of elongated ribs. Each of the elongated plurality of ribs has, in cross section, a bottom wall, first and second upstanding side walls extending upward from the bottom wall, and a web extending between the first and second side walls at a location intermediate the bottom wall and an upper side wall end. The web and portions of the first and second side walls above the web form a channel. A first hole extends through the web, and a second hole extends through the bottom wall generally in coaxial alignment with the first hole. In one disclosed embodiment, a light bulb is disposed within the first and second holes, and an insulated electrical conductor runs along the length of the elongated rib within the channel to connect the light bulb to a source of electrical power. In another aspect of the invention, the source of electrical power is a battery optionally charged by a solar panel.

DETAILED DESCRIPTION

Figure 1:
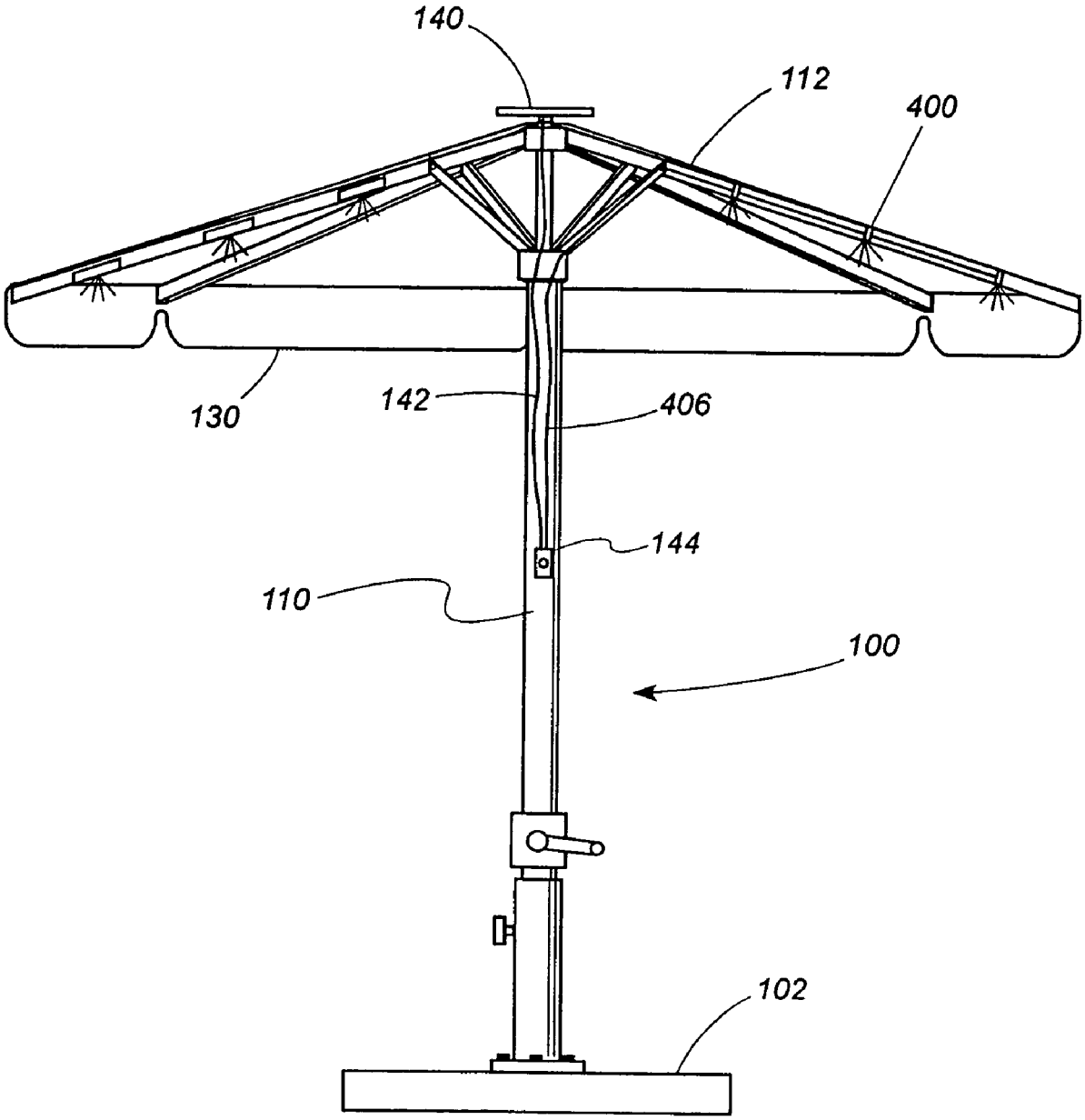
FIG. 1 illustrates an exemplary umbrella according to one embodiment of the present invention.
Figure 2:
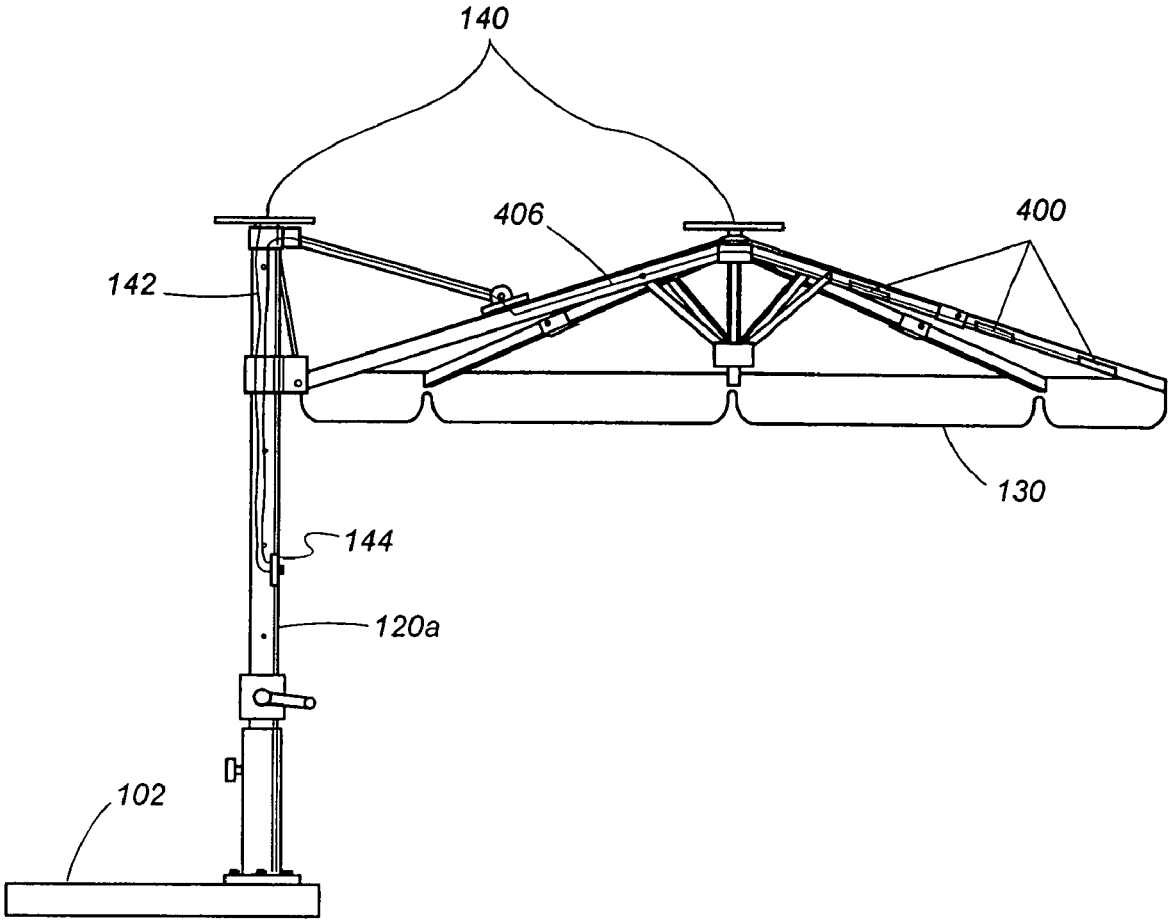
FIG. 2 illustrates an alternative support embodiment for an exemplary umbrella according to an embodiment of the present invention.

FIG. 1 illustrates an exemplary embodiment of a patio umbrella 100 according to one embodiment of the present invention. The umbrella 100 comprises a base member 102 substantially normal to a first support member 110. In FIG. 1, the support member is shown generally central to the umbrella 100 or in a "market umbrella" configuration. Embodiments of the present invention can be employed in any style umbrella support, such as an offset support, side post support, cantilevered support, or other support configuration. For example, FIG. 2 shows an embodiment of an offset first support member comprising a flexible top portion extending at an angle from the support member.

The first support member 110 supports a plurality of elongated canopy support ribs 112. The canopy support ribs 112 support a canopy 130. The canopy 130 can comprise any suitable covering for the support ribs 112, such as a knitted or woven fabric, for example, and is generally configured to provide shade and protection for an area underneath the canopy 130. In the embodiment shown, the first support member 110 also supports a solar panel 140 comprising photovoltaic cells configured to convert energy from sunlight incident on the panel 140 into electrical energy. According to one embodiment, the electrical energy generated by the solar panel 140 is carried by conductor 142 to a battery for later use.

Figure 3:
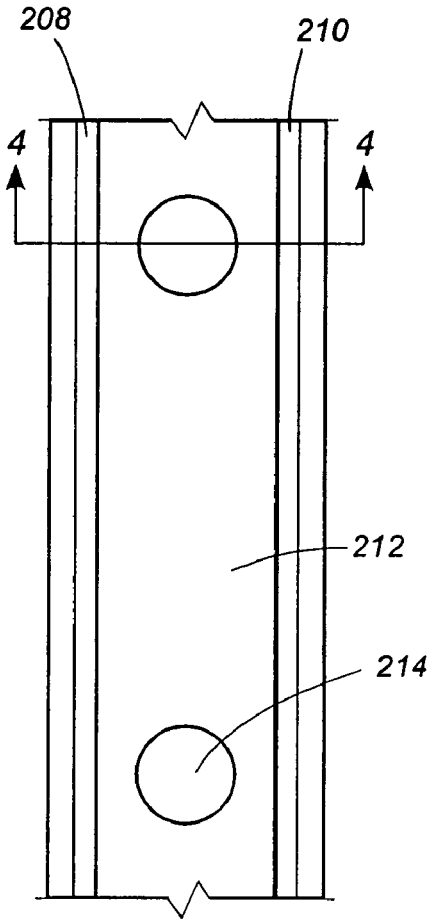
FIG. 3 illustrates an exemplary top view of an umbrella support rib.

FIG. 3 illustrates a top view of the umbrella support rib 112 with the canopy portion 130 pulled back. According to the embodiment shown in FIG. 3, a web 212 runs the length of the rib 112 and contains a plurality of openings 214 spaced along the length of the rib 112 and substantially coaxial with corresponding openings 216 in a bottom wall 202 (shown in FIG. 4). The placement, number, and spacing of the openings 214 and 216 can vary depending on the desired placement, number, and spacing of the components to be located within the openings 214 and 216. For example, it may be desirable to have evenly spaced lights along the umbrella support ribs 112 to provide convenient lighting underneath the canopy 130. In such case, openings 214 and 216 can be evenly spaced along the umbrella support ribs 112 at such intervals to allow for the desired number of lights.

Figure 4:
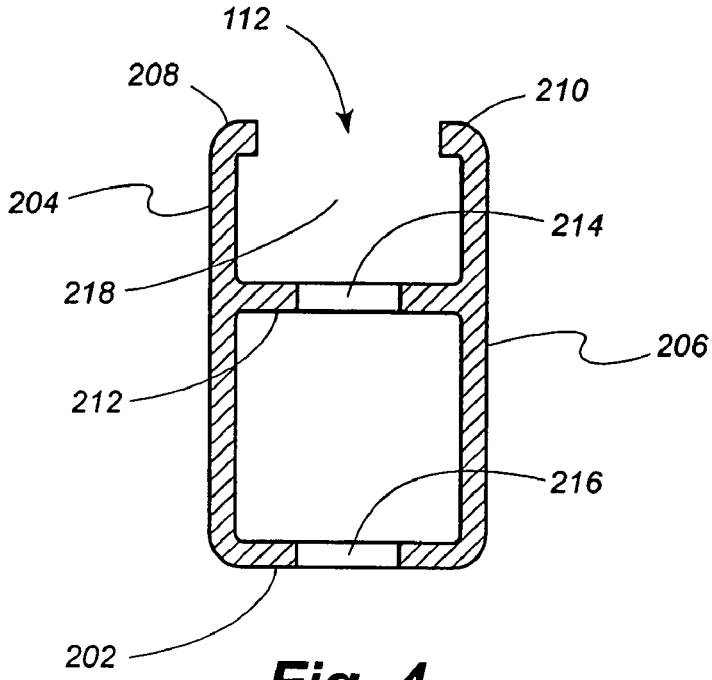
FIG. 4 illustrates a cross section of the support rib illustrated in FIG. 3.

FIG. 4 illustrates an exemplary cross section of the umbrella support rib 112 illustrated in FIG. 3. The umbrella support rib 112 shown in FIG. 4 comprises a bottom wall 202. Opposed first and second upstanding side walls 204, 206 extend from the bottom wall 202 to upper side wall ends. The first and second upstanding side walls 204, 206 comprise inwardly extending support portions 208 and 210, respectively, at the upper wall ends. The support portions 208 and 210 protrude from the first and second upstanding side walls 204, 206 and are configured to support a portion of the canopy 130. The support portions 208, 210 are preferably smoothly curved to minimize wear on the canopy 130 resulting from contact with the upper wall end of the first and second upstanding side walls 204 and 206.

The umbrella support rib 112 further comprises a web 212 extending between the first and second side walls 204 and 206 at a location intermediate the bottom wall 202 and the upper side wall end. First and second substantially coaxial openings

Figure 5:
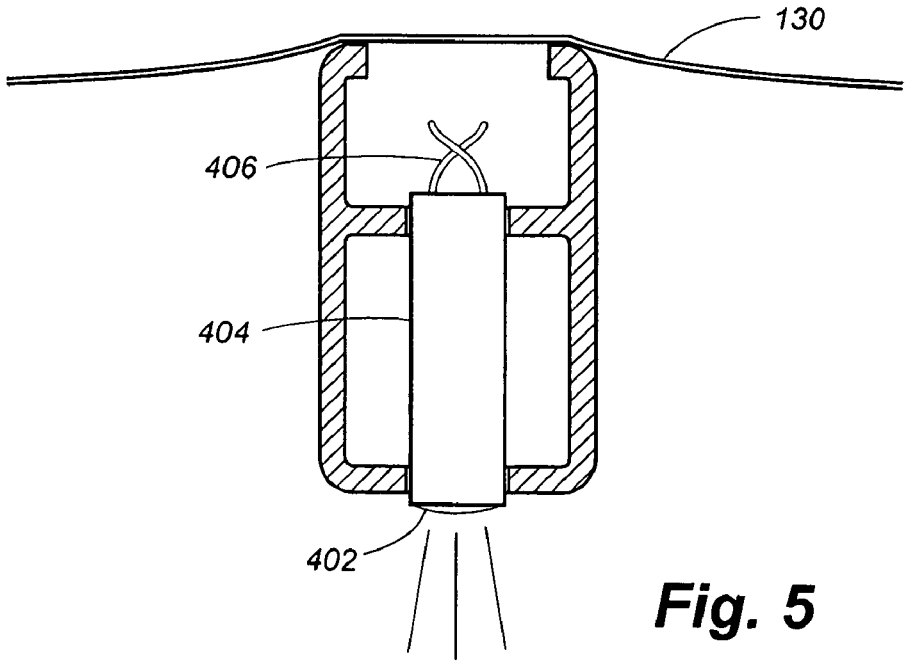
FIG. 5 illustrates the exemplary cross section of FIG. 4 with an accompanying light, wiring, and canopy.

214, 216 are formed in the web 212 and the bottom wall 202. The openings 214 and 216 are configured to house an electrical component, such as a light 402 as illustrated in FIG. 5. The light 402 can be any suitable type of light such as a light emitting diode (LED), incandescent bulb, fluorescent lamp, or other appropriate light source. Preferably, the light 402 should be efficient and durable so that it can produce sufficient light over a sustained period of time with minimal power consumption and without frequent replacement. According to other embodiments, other components can be housed in the openings 214 and 216 such as speakers, electrical fans, insect repelling devices, or other suitable items.

As illustrated in FIG. 5, the light 402 is contained within a casing 404 configured to mount flush inside openings 214 and 216. Preferably, the web 212 supplies sufficient pressure on the casing 404, or contains other suitable retaining structure, to keep the light secured in the openings 214 and 216, while at the same time allowing for easy insertion and removal. For example, the casing 404 can be configured to snap, screw, push against, or otherwise mate with the web 212 according to a variety of embodiments known to those skilled in the art, to allow the casing 404 to be easily removed when replacing the light 402 and then easily re-inserted.

In FIG. 5, it can be seen that the web 212 and upper portions of the first and second side walls 204, 206 define a channel 218 within the umbrella support rib 200. The channel 218 provides a recess for electrical conductor 406 configured to carry current to the light 402. The channel thus allows the electrical conductor 406 to be safely and conveniently connected to the battery and/or solar panel 140 and/or switch 144. The channel 218 also allows movement of the umbrella support ribs 112 when opening and closing the umbrella without damaging the electrical conductor 406. By providing a covered channel for the electrical conductor 406, the channel 218 helps protect the electrical conductor 406 from weathering and from becoming entangled on foreign objects or other parts of the umbrella 100 and improves the aesthetic appeal of the umbrella 100 by keeping the electrical conductor 406 hidden from view. The open upper wall end of the channel 218 also provides convenient access to the channel 218 in order to install, repair, or maintain umbrella components, such as the light 402 and conductor 406.

Figure 6:
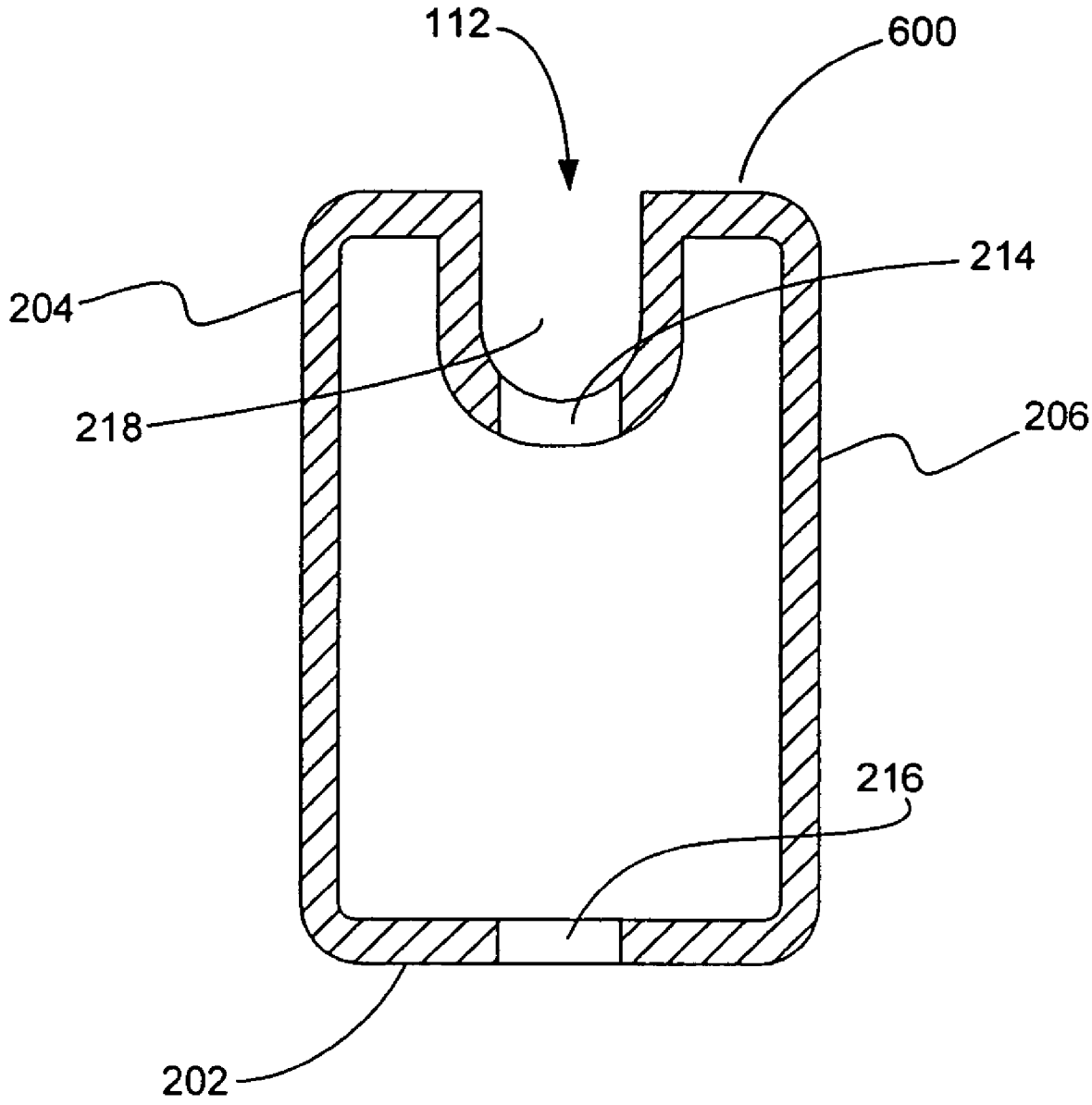
FIG. 6 illustrates another exemplary cross section of an umbrella support rib according to another embodiment of the invention.

FIG. 6 illustrates an alternative embodiment of the umbrella support rib 112. According to the embodiment illustrated in FIG. 6, the support rib 112 comprises first and second side walls 204 and 206 connected at an upper side wall end to a curved upper surface 600 defining a channel 218. The upper surface 600 comprises openings 214 within the channel 218 substantially coaxial with corresponding openings 216 in a bottom wall 202. As discussed in connection with FIGS. 3-5 above, the openings 214 and 216 can be configured to house devices such as lights or other suitable electrical appliances. It will be appreciated that the embodiment illustrated in FIG. 6 includes the same features discussed above in connection with FIGS. 3-5 and allows for a different construction process. For example, the embodiment illustrated in FIG. 6 can be machined from a single piece of rectangular metal tubing in which a press is used to indent the upper surface 600 to form the channel 218.

While the above description contains many specifics, these specifics should not be construed as limitations on the scope of the invention, but merely as exemplifications of the disclosed embodiments. Those skilled in the art will envision many other possible variations that are within the scope of the invention.

What is claimed is:

1. An umbrella, comprising:

a first support member;

a plurality of elongated ribs supported by said first support member; and a canopy supported by said plurality of elongated ribs, wherein at least one of said plurality of elongated ribs has, in cross section, a bottom wall;

a first upstanding side wall extending upward from said bottom wall to an upper side wall end;

a second upstanding side wall extending upward from said bottom wall to the upper side wall end;

a web extending between said first and second side walls at a location intermediate said bottom wall and said upper side wall ends, said web and portions of said first and second side walls above said web forming a channel, and said web and portions of said first and second side walls below said web forming a cavity;

a first hole extending through said web; and a second hole extending through said bottom wall generally in coaxial alignment with said first hole;

a bulb extending from below said second hole, up through said cavity, to said first hole, whereby the bulb may be readily accessed from said channel for insertion into or removal from said cavity, and wherein an electrical conductor runs from the bulb along said channel, to a source at electrical power.

2. The umbrella of claim 1 wherein said source of electrical power comprises a battery charged by a solar panel.

3. The umbrella of claim 1, wherein the upper side wall end of the first and second upstanding side walls comprise a rounded rim portion configured to support the canopy.

4. The umbrella of claim 1, wherein the bulb is selected from the group consisting of a light emitting diode, an incandescent bulb, and a fluorescent lamp.

5. The umbrella of claim 1 wherein the bulb comprises a light emitting portion and a separable housing portion.

* * * * *